US009177736B2

(12) United States Patent
Barnas et al.

(10) Patent No.: US 9,177,736 B2
(45) Date of Patent: Nov. 3, 2015

(54) SWITCH COVER LIMITING MANUAL SWITCH ACTIVATION

(75) Inventors: Jean-Christophe Barnas, Les Pontes (FR); Florencio Llanca Bolivar, Lausanne (CH)

(73) Assignee: EATON INDUSTRIES MANUFACTURING GMBH, Morges (CH)

( * ) Notice: Subject to any disclaimer, the term of this patent is extended or adjusted under 35 U.S.C. 154(b) by 94 days.

(21) Appl. No.: 13/697,036

(22) PCT Filed: May 10, 2011

(86) PCT No.: PCT/EP2011/057530

§ 371 (c)(1),
(2), (4) Date: Jan. 17, 2013

(87) PCT Pub. No.: WO2011/141468

PCT Pub. Date: Nov. 17, 2011

(65) Prior Publication Data

US 2013/0206552 A1 Aug. 15, 2013

(30) Foreign Application Priority Data

May 10, 2010 (GB) ..... 1007740.2

(51) Int. Cl.

| | |
|---|---|
| ***H01H 9/28*** | (2006.01) |
| ***H01H 9/22*** | (2006.01) |
| *H01H 9/16* | (2006.01) |
| *H01H 71/10* | (2006.01) |
| *H01H 3/02* | (2006.01) |

(52) U.S. Cl.

CPC ..... *H01H 9/287* (2013.01); *H01H 9/22* (2013.01); *H01H 9/16* (2013.01); *H01H 71/1054* (2013.01); *H01H 2003/028* (2013.01)

(58) Field of Classification Search

USPC ..... 200/43.19, 43.21, 43.22, 43.11, 293, 200/293.1, 330, 333, 334, 304, 308

IPC ..... H01H 71/62,71/10, 9/22, 9/223, 9/282

See application file for complete search history.

(56) References Cited

U.S. PATENT DOCUMENTS

| | | | | |
|---|---|---|---|---|
| 6,392,170 | B1 * | 5/2002 | Wechsler | 200/43.21 |
| 7,019,240 | B2 * | 3/2006 | Eberts et al. | 200/331 |

FOREIGN PATENT DOCUMENTS

| | | |
|---|---|---|
| DE | 1783282 U | 2/1959 |
| DE | 3032756 A1 | 4/1982 |
| EP | 0441722 A1 | 8/1991 |
| EP | 0694947 A1 | 1/1996 |

OTHER PUBLICATIONS

European Patent Office, International Search Report in International Patent Application No. PCT/EP2011/057530 (Aug. 2, 2011).

* cited by examiner

*Primary Examiner* — Vanessa Girardi
(74) *Attorney, Agent, or Firm* — Leydig, Voit & Mayer, Ltd.

(57) ABSTRACT

A protective covering device for a circuit breaker having a breaker housing and breaker handle extending from a front surface of the breaker housing and having an ON and OFF position includes: a cover adapted to be mounted to the front surface of the circuit breaker; and an opening provided in the cover adapted to allow actuation of the breaker handle when the breaker handle is in the OFF position. The cover encloses the breaker handle when mounted.

8 Claims, 6 Drawing Sheets

SWITCH COVER LIMITING MANUAL SWITCH ACTIVATION

CROSS-REFERENCE TO RELATED APPLICATIONS

This patent application is a national stage entry under 35 U.S.C. §371 of International Application No. PCT/EP2011/057530, filed May 10, 2011, and claims priority to Great Britain Patent Application No. 1007740.2, filed May 10, 2010. The International Application was published in English on Nov. 17, 2011, as WO 2011/141468 A1.

FIELD

The present invention relates to a protective covering device for an electrical safety device having a breaker housing and breaker handle extending from a front surface of the breaker housing and having an ON and OFF position

BACKGROUND

The term "electrical safety device" comprises devices which protect individuals against an electrical shock, e.g. a Residual Current Device (RCD) or a Residual Current Circuit Breaker (RCCB), devices which protect electrical circuits or electrical appliances from damage caused by overcurrent, e.g. circuit breakers (such as a MCB or a MCCB), as well as devices which provide both types of electrical safety, e.g. a Residual Current Breaker with Overcurrent protection (RCBO), as long as those devices are provided with a trip mechanism with an actuator lever.

In rail applications, there are breakers which protect safety functions such as emergency brake loop, default ground current monitoring, over speed loop, black record box, etc. These breakers are called signaling breakers. These breakers cannot mechanically be operated. Only electrical triggering is considered in these applications. It is only allowed to remote the breaker, i.e. resetting the breaker remotely without coming into physical contact with the breaker, in the event of a potential breaker triggering. For some critical safety functions, this remote is performed under specific process in such a way that a common agent or driver cannot remote the breaker. Only qualified upgraded personnel are allowed to do this after filling out procedural documents.

Until now only special breakers allowed the above functions. These breakers do not have any handle like regular circuit breakers. The remote of the breaker is done via a small key tooling. Such special breakers are relatively expensive.

SUMMARY

In an embodiment, the present invention provides a protective covering device for a circuit breaker having a breaker housing and breaker handle extending from a front surface of the breaker housing and having an ON and OFF position. The protective covering device includes: a cover adapted to be mounted to the front surface of the circuit breaker; and an opening provided in the cover adapted to allow actuation of the breaker handle when the breaker handle is in the OFF position. The cover encloses the breaker handle when mounted.

DETAILED DESCRIPTION

Figure 1:
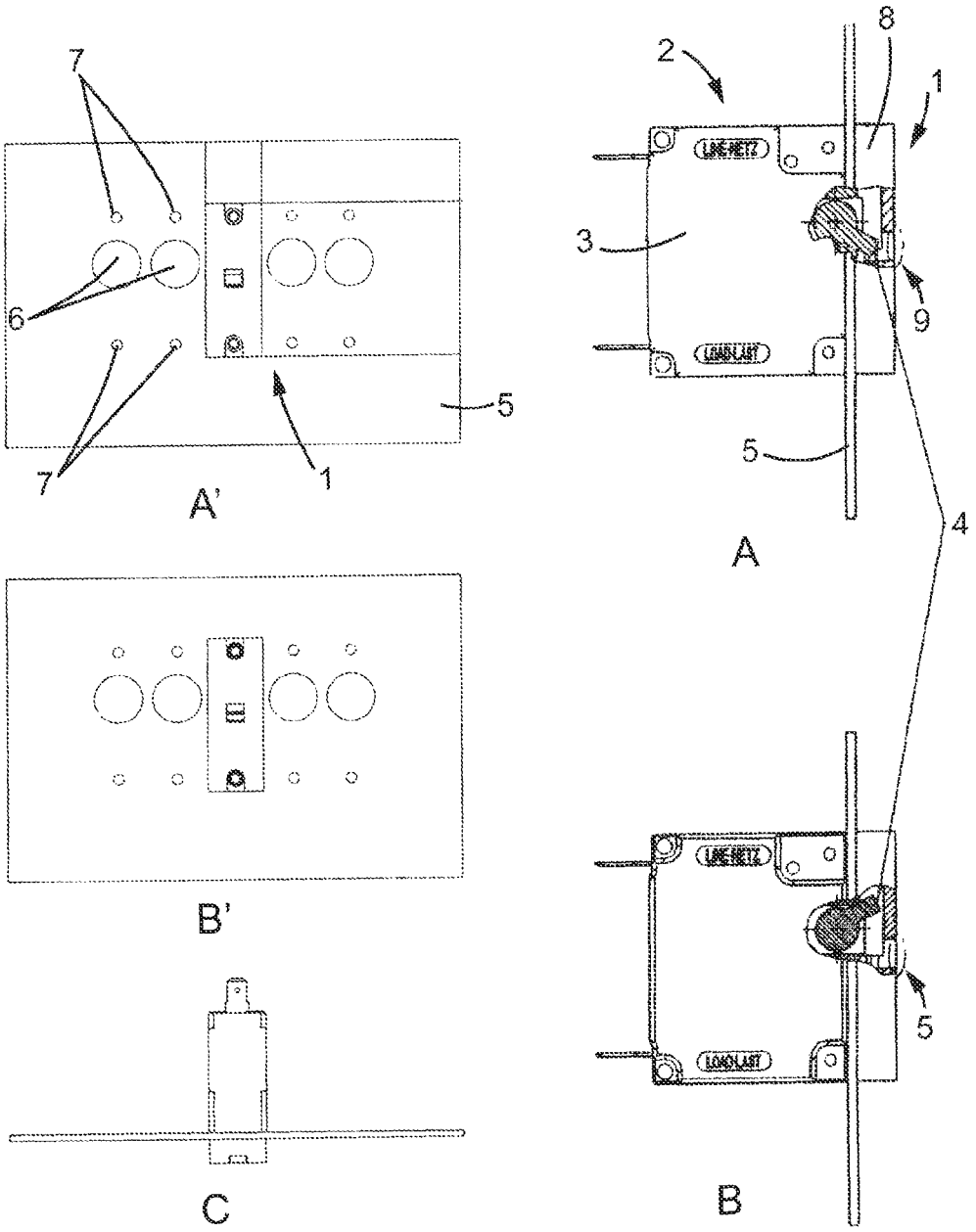
FIG. 1 shows a first embodiment of an assembly of a circuit breaker and a protective covering device according to the invention. This figure shows respectively the assembly in an OFF position in lateral view (FIG. 1A) and front view (FIG. 1A'); in an ON position in lateral view (FIG. 1B) and front view (FIG. 1B'); in top view (FIG. 1C); and in three-dimensional view (Fig. D).

According to the invention there is provided the protective covering device which comprises a cover adapted to be mounted to the front surface of the circuit breaker while enclosing the breaker handle, and an opening provided in the cover adapted to allow actuation of the breaker handle when it is in the OFF position.

Such a protective covering device prevents access to the handle of the electrical safety device in its ON position. In this way it is not possible to manual trigger the breaker. When the breaker has tripped, the handle can be actuated through the opening. The operator can for example use a screw driver to bring the handle back to its ON position.

The opening in the cover is preferably provided proximate the OFF position of the breaker handle. The opening provides a simple indicator to show the operator the status of the safety device: if the handle is visible in the opening the breaker has tripped. This is especially advantageously when a large number of safety devices are mounted on a panel wall and/or in a cabinet.

In a further embodiment, there is provided an actuator adapted to extend between the opening and the breaker handle in the OFF position. In this embodiment it is not necessary to use screw driver or something similar to reset the breaker. The operator can move the handle back in its ON position by means of the actuator.

Advantageously, the actuator comprises a slide which is moveable relative to the cover to bring the breaker handle into its ON position. Such a slide or push bar can move between the breaker and the cover.

The actuator further comprises a spring arranged between the slide and the cover to pre-load the slide to an initial position in which the slide is retracted from the breaker handle in its ON position. After operation, the slide will be returned to its initial position where it is ready for the next operation.

In this further embodiment the handle is located behind the cover. To provide a visual indication of the status of the breaker to an operator, the cover comprises a second opening proximate the OFF position of the breaker handle. Similar as described above, this opening will not allow access to the handle when it is in its ON position but when it has tripped the handle will appear in the opening indicating to the operator that the breaker has tripped. Alternatively, an indicator member can be linked to the breaker handle. This indicator member comprises on its front surface codes indicative of the ON and OFF positions of the breaker, which codes are to be positioned in the second opening. In this case, not the handle but a part of the surface of the indicator member will be visible in the opening of the cover.

The cover is preferably formed by a top wall and one or more side walls. The opening for allowing actuation of the breaker handle when it is in the OFF position as well as two screw holes are arranged in the top wall.

In another aspect of the invention, there is provided an assembly of a circuit breaker and a protective covering device as described above.

In yet another aspect of the invention, the assembly of a circuit breaker and a protective covering as described herein are used for rail application.

The drawings show three different embodiments according to the invention. The same constructional elements are indicated with the same reference numbers.

Figure 2:
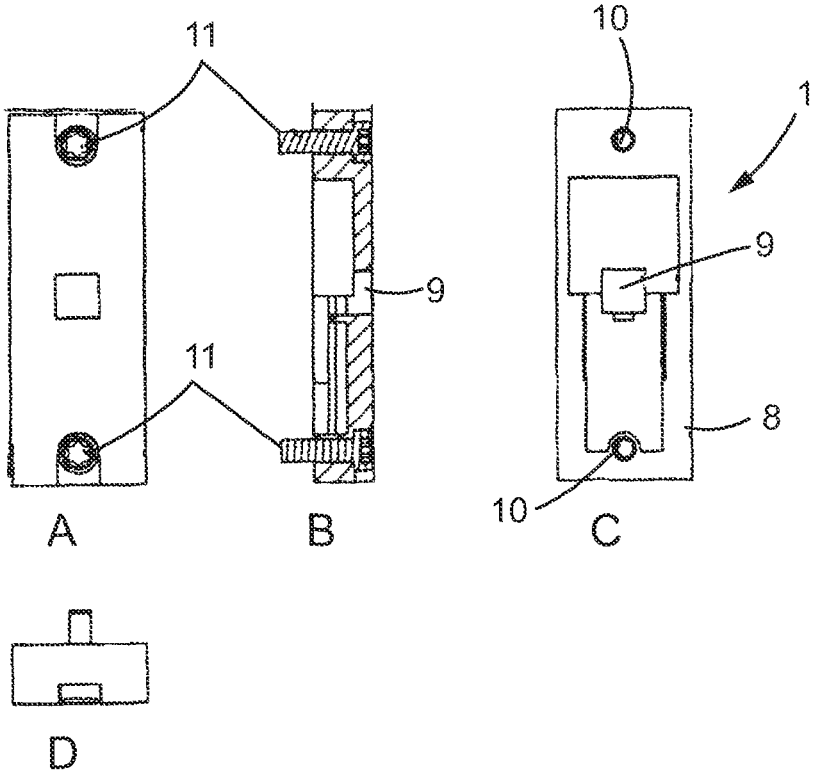
FIG. 2 shows the protective covering device of FIG. 1 in front view (FIG. 2A), cross-sectional view (FIG. 2B); in back view (FIG. 2C) and in top view (FIG. 2D).

In FIG. 1 and FIG. 2 there is shown a protective covering device or protection device 1 for a circuit breaker 2. The breaker 2 has a breaker housing 3 and breaker handle 4 extending from a front surface of the breaker housing 3. The handle 4 has two different positions: an OFF position (see FIGS. 1A and A') and an ON position (see FIGS. 1B and 1B'). The breaker 2 is located behind a panel wall 5, which is part of a cabinet or enclosure (not shown). The panel wall 5 is provided with openings 6 to allow the handle 4 of the breaker 2 to extend through the panel wall 5 to the front side of the wall 5. Furthermore, holes 7 are provided in the panel wall 5 above and below each opening 6.

The protection device 1 comprises a cover 8 and an opening 9 in the cover. The cover 8 has a front wall and a four side walls. The cover 8 is mounted to the front surface of the circuit breaker 2 while enclosing the breaker handle 4. The cover 8 is provided with holes 10 with are aligned with the holes 7 in the panel wall 5. Screws 11 will simultaneously fix the cover 8 and the breaker 2 to the panel wall 5. The holes 10 are preferably arranged flushed with the front surface of the cover 8 such that the screws 11 will not extend from the front surface of the cover 8. Alternatively, the breaker 2 is fixed with one set of screws to the panel wall, and the cover 8 is fixed with another set of screws to the panel wall 5 in which case the panel wall comprises two sets of holes 7 located at different heights on the cover 8.

The opening 9 is arranged in the front wall of the cover 8 proximate to the OFF position of the handle 4 (see FIG. 1A). When the handle 4 is in the ON position, it will be located behind the front wall of the cover 8 out of reach for an operator. Hence, in normal operation an operator will not be able to inactivate the breaker 2 which will ensure the protective or trip function of the breaker 2; only electrical situations will make the handle 4 to go to the OFF position. Once the breaker 2 has tripped, the handle 4 will appear in the opening 9 providing a visual indication that the breaker 2 has tripped. The location and dimensions of the opening 9 is such that actuation of the breaker handle 4 is possible when the handle 4 is in the OFF position. For example by means of a screw driver or similar tool the handle 4 can be lifted upwardly until it moves back into its ON position.

Figure 3:
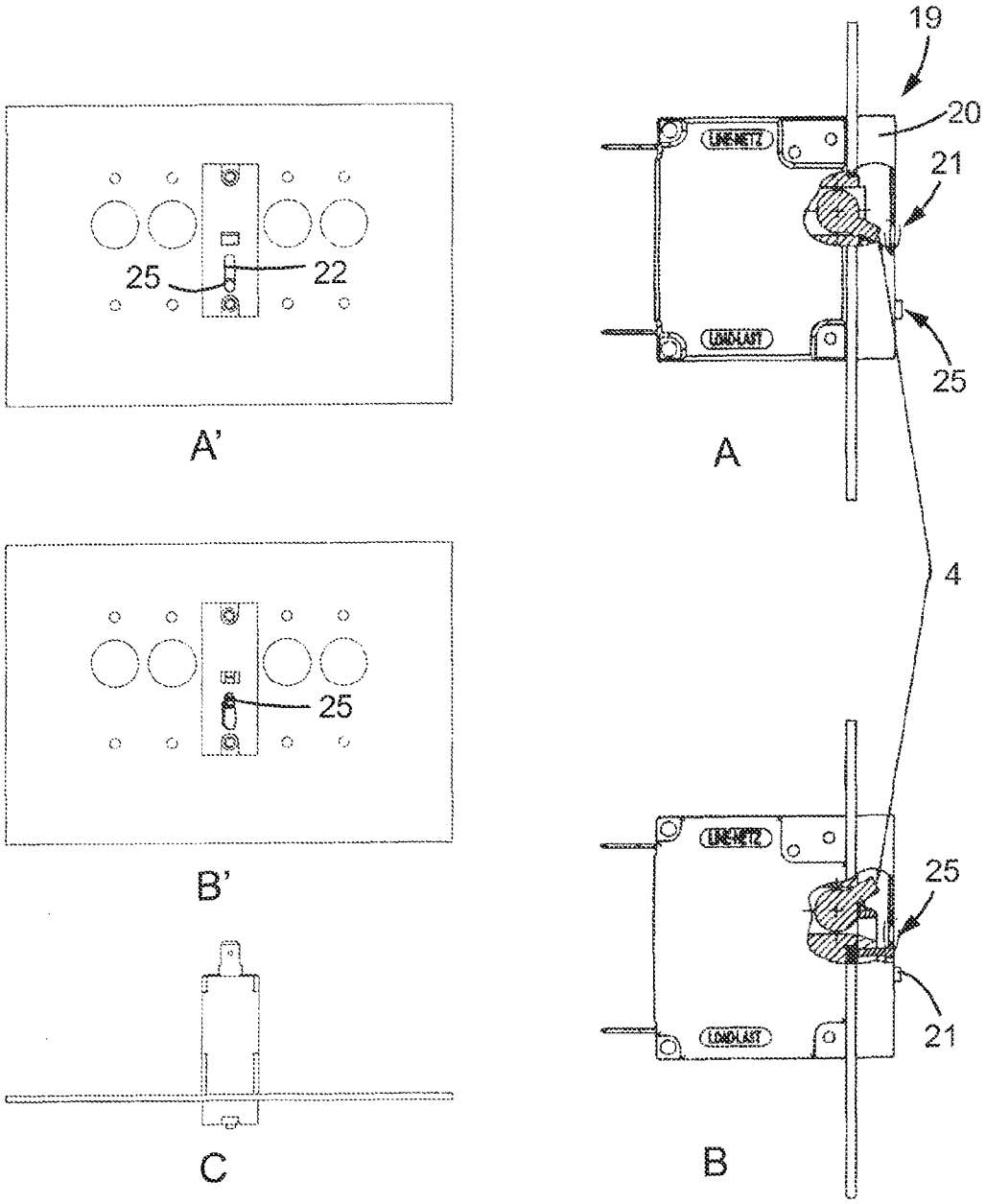
FIG. 3 shows a second embodiment of an assembly of a circuit breaker and a protective covering device according to the invention. This figure shows respectively the assembly in an OFF position in lateral view (FIG. 1A) and front view (FIG. 1A'); in an ON position in lateral view (FIG. 1B) and front view (FIG. 1B'); in top view (FIG. 1C); and in three-dimensional view (Fig. D).
Figure 4:
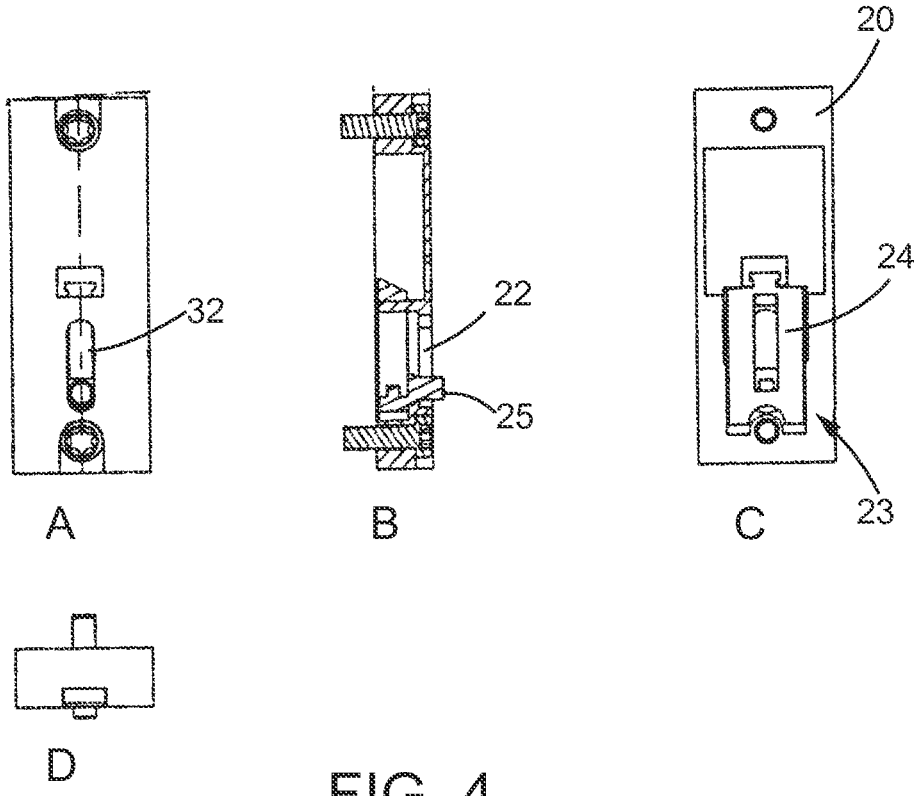
FIG. 4 shows the protective covering device of FIG. 2 in front view (FIG. 4A), cross-sectional view (FIG. 4B); in back view (FIG. 4C) and in top view (FIG. 4D).
Figure 5:
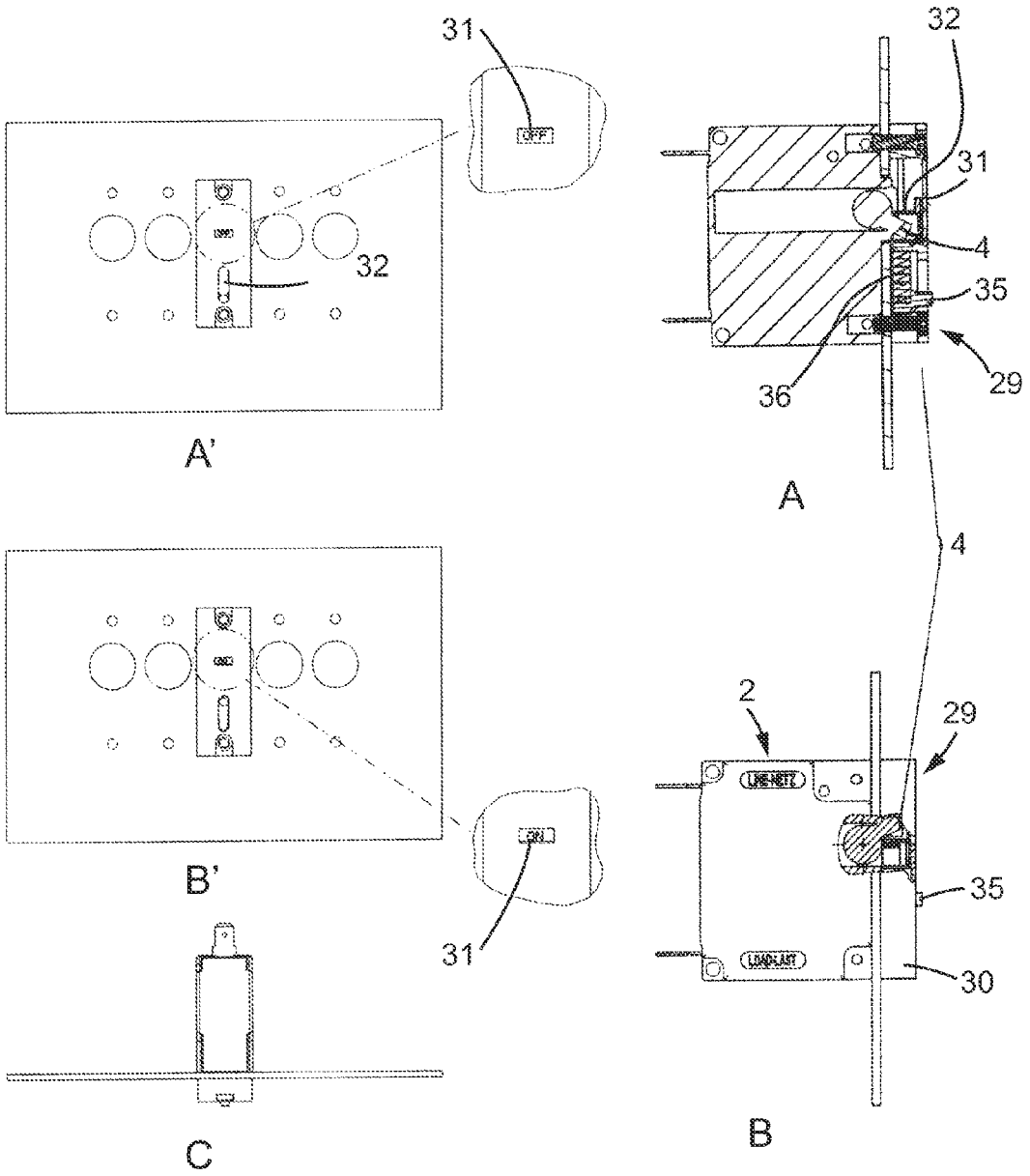
FIG. 5 shows a third embodiment of an assembly of a circuit breaker and a protective covering device according to the invention. This figure shows respectively the assembly in an OFF position in lateral view (FIG. 1A) and front view (FIG. 1A'); in an ON position in lateral view (FIG. 1B) and front view (FIG. 1B'); in top view (FIG. 1C); and in three-dimensional view (Fig. D).
Figure 6:
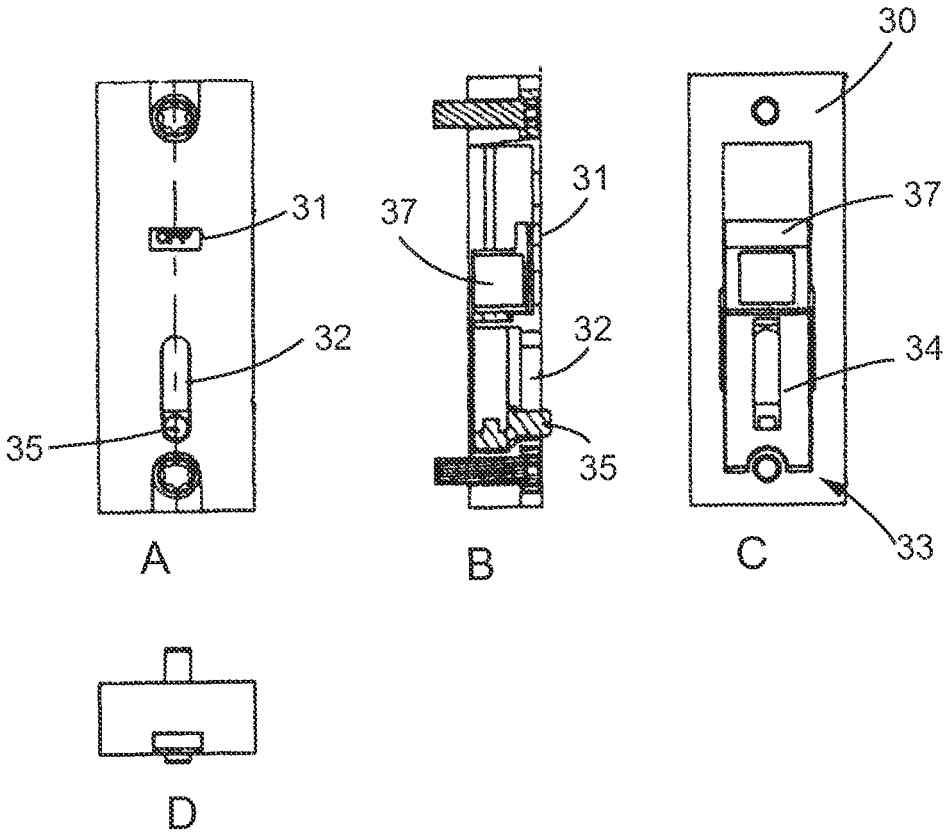
FIG. 6 shows the protective covering device of FIG. 5 in front view (FIG. 6A), cross-sectional view (FIG. 6B); in back view (FIG. 6C) and in top view (FIG. 6D).

FIGS. 3 and 4 show a second embodiment; and FIGS. 5 and 6 show a third embodiment. Both embodiments show a protection device 19, 29 comprising a cover 20, to be mounted over the breaker 2 front face, using two screws similar to the first embodiment. An opening 21, 31 in the cover 20, 30 will provide a visual indication of the ON and OFF positions of the breaker handle 4. This indication will inform an operator about the breaker 2 status ON/OFF. In the second embodiment, the opening 21 shows the breaker handle 4 when it is in the OFF position (see FIGS. 3A and A') similar as in the first embodiment. The third embodiment has a moveable indicator member 37 linked or attached to the handle 4 which can slide relative to the opening 31 in the cover 30. On the front surface of this member 37, codes indicative of the ON and OFF positions of the breaker 2 are provided. These codes can be for example the words "ON" and "OFF" and/or color codes such as red for OFF and green for ON. In this third embodiment only the indicator member code ON or OFF can be seen through the opening 31 (see FIGS. 5 A' and B'); the handle 4 remains hidden and inaccessible by the cover 30.

In the second and third embodiments, the cover 20, 30 has an elongated opening 22, 32 and an actuator 23, 33 adapted to extend between the opening 22, 32 and the breaker handle 4 in the OFF position behind the front wall of the cover 20, 30. The actuator 23, 33 comprises a slide 24, 34 which is moveable relative to the cover 20, 30. The slide 24, 34 has a pin 25, 35 which extends through the elongated opening in the cover 20, 30. The pin 25, 35 allows the operator to reset the breaker handle 4 in the event that it has tripped. For that reason the operator will move the pin 25, 35 upwardly in the elongated opening 22, 32. The slide 24, 34 will contact the handle 4, move it upwardly until it is placed back into its ON position. A spring 36 may be provided between the slide 34 and the cover 30 (see FIG. 6C) in such a way that it will be compressed when the slide 34 is operated to bring the handle 4 back to the ON position. In this way, the spring 36 will return the slide 34 to its initial position after being operated. The spring 36 is designed such that it will not impede the tripping function of the breaker 2.

As an alternative solution, depending on the space available behind the cover, a relatively small switch, e.g. a micro switch, could be integrated at the upper part of the cover. Two faston terminals could be placed at the rear of the cover in order to connect DC voltage. Two wires associated to a red flashing LED and resistor linked to the micro-switch could inform the status of the breaker 2 ON/OFF as well.

Having thus described the invention with reference to preferred embodiments, it is to be appreciated that modifications and variations are possible to the described arrangements without departure from the scope of the invention.

The invention claimed is:

1. A protective covering device for a circuit breaker having a breaker housing and breaker handle extending from a front surface of the breaker housing and having an ON and OFF position, the protective covering device comprising:

a cover adapted to be mounted to the front surface of the circuit breaker, wherein the cover encloses the breaker handle when mounted;

an opening provided in the cover adapted to allow actuation of the breaker handle when the breaker handle is in the OFF position; and an actuator adapted to extend between the opening and the breaker handle in the OFF position, wherein the breaker handle is positioned behind a front wall of the cover out of reach of an operator when in the ON position, and wherein the actuator comprises a slide which is moveable relative to the cover to bring the breaker handle into the ON position and a spring arranged between the slide and the cover to pre-load the slide to an initial position in which the slide is retracted from the breaker handle in the ON position.

2. The protective covering device according to claim 1, wherein the opening provided in the cover is provided proximate the breaker handle in the OFF position.

3. The protective covering device according to claim 1, further comprising a second opening in the cover for providing a visual indication of the ON and OFF positions of the breaker handle.

4. The protective covering device according to claim 3, in which the second opening in the cover is provided proximate the OFF position of the breaker handle.

5. The protective covering device according to claim 3, further comprising:

a indicator member adapted to be linked to the breaker handle, the indicator member comprising on its front surface codes indicative of the ON and OFF positions of the breaker, wherein the codes are positioned in the second opening.

6. An assembly, comprising:

a circuit breaker, comprising:

a breaker housing; and a breaker handle extending from a front surface of the breaker housing and having an ON and OFF position; and a protective covering device, comprising:

a cover adapted to be mounted to the front surface of the circuit breaker, wherein the cover encloses the breaker handle when mounted;

an opening provided in the cover adapted to allow actuation of the breaker handle when the breaker handle is in the OFF position; and an actuator adapted to extend between the opening and the breaker handle in the OFF position, wherein the breaker handle is positioned behind a front wall of the cover out of reach of an operator when in the ON position, and wherein the actuator comprises a slide which is moveable relative to the cover to bring the breaker handle into the ON position and a spring arranged between the slide and the cover to pre-load the slide to an initial position in which the slide is retracted from the breaker handle in the ON position.

7. A method of using a protective covering device for a circuit breaker having a breaker housing and breaker handle extending from a front surface of the breaker housing and having an ON and OFF position, the method comprising:

providing the protective covering device mounted to the front surface of the circuit breaker and enclosing the breaker handle;

actuating the breaker handle when the breaker handles is in the OFF position through an opening provided in a cover of the protective covering device to move a slide of an actuator relative to the cover to bring the breaker handle into the ON position to move the breaker handle behind a front wall of the cover into the ON position out of reach of an operator, wherein the actuator extends between the opening and the breaker handle in the OFF position; and pre-loading, via a spring arranged between the slide and the cover, the slide to an initial position in which the slide is retracted from the breaker handle in the ON position.

8. A protective covering device for a circuit breaker having a breaker housing and breaker handle extending from a front surface of the breaker housing and having an ON and OFF position, the protective covering device comprising:

a cover adapted to be mounted to the front surface of the circuit breaker, wherein the cover encloses the breaker handle when mounted;

an opening provided in the cover adapted to allow actuation of the breaker handle when the breaker handle is in the OFF position; and an actuator adapted to extend between the opening and the breaker handle in the OFF position, wherein the actuator includes a slide which is moveable relative to the cover to bring the breaker handle into the ON position, wherein the actuator further includes a spring arranged between the slide and the cover to pre-load the slide to an initial position in which the slide is retracted from the breaker handle in the ON position.

* * * * *